US007993033B2

(12) United States Patent
Moriyama et al.

(10) Patent No.: US 7,993,033 B2
(45) Date of Patent: Aug. 9, 2011

(54) REFLECTOR AND LIGHTING APPARATUS COMPRISING REFLECTOR

(75) Inventors: Takayoshi Moriyama, Miura (JP); Kazunari Higuchi, Yokohama (JP); Sumio Hashimoto, Yokosuka (JP); Shinichi Kumashiro, Yokohama (JP)

(73) Assignees: Toshiba Lighting & Technology Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 92 days.

(21) Appl. No.: 12/470,223

(22) Filed: May 21, 2009

(65) Prior Publication Data

US 2009/0290354 A1 Nov. 26, 2009

(30) Foreign Application Priority Data

May 22, 2008 (JP) ..... 2008-134855
Mar. 24, 2009 (JP) ..... 2009-071275

(51) Int. Cl.
*F21V 7/00* (2006.01)

(52) U.S. Cl. ..... 362/296.01; 362/215; 362/217.05; 362/241; 362/297; 362/346

(58) Field of Classification Search ..... 362/197, 362/208, 215, 217.05, 296.01, 297, 327, 362/328, 341, 346, 236–248
See application file for complete search history.

(56) References Cited

U.S. PATENT DOCUMENTS 1,683,599 A 9/1928 Percy
3,539,801 A 11/1970 Bobrick
4,963,798 A * 10/1990 McDermott ..... 315/312
5,580,156 A 12/1996 Suzuki et al.
6,196,707 B1 * 3/2001 Deckard ..... 362/473
6,367,949 B1 * 4/2002 Pederson ..... 362/240
6,527,411 B1 * 3/2003 Sayers ..... 362/245
6,552,658 B1 4/2003 Roller
6,739,734 B1 5/2004 Hilgan
6,840,654 B2 1/2005 Guerrieri et al.
7,241,019 B1 7/2007 Tsai
7,434,955 B2 * 10/2008 Vickers et al. ..... 362/205
7,566,154 B2 7/2009 Gloisten (Continued)

FOREIGN PATENT DOCUMENTS

DE 20 2004 001720 4/2004

(Continued)

OTHER PUBLICATIONS

English Abstract of JP-2006-228932 published Aug. 31, 2006.

(Continued)

*Primary Examiner* — Anabel M Ton
*Assistant Examiner* — Danielle Allen
(74) *Attorney, Agent, or Firm* — DLA Piper LLP US

(57) ABSTRACT

A reflector built in a down light includes a plurality of floodlight openings respectively exposing a plurality of light-emitting elements to a front surface side, a plurality of radial partition walls which respectively partition and surround these floodlight openings, and an inner circumferential partition wall. Each of the partition walls has a ridge line, and the reflector includes a plurality of reflection concave surfaces each which open and widen from a respective one of the plurality of floodlight openings towards ridge lines of the plurality of partition walls which respectively surround the plurality of floodlight openings. The plurality of radial partition walls extend from the center of the reflector towards the outer circumference, and the inner circumferential partition wall is located between the center and the outer circumference.

2 Claims, 7 Drawing Sheets

U.S. PATENT DOCUMENTS

| | | | | |
|---|---|---|---|---|
| 7,604,365 | B2 | 10/2009 | Chang | |
| 7,794,114 | B2 | 9/2010 | Medendorp | |
| 2002/0093820 | A1* | 7/2002 | Pederson | 362/241 |
| 2003/0081419 | A1 | 5/2003 | Jacob | |
| 2003/0137838 | A1 | 7/2003 | Rizkin et al. | |
| 2003/0156410 | A1 | 8/2003 | Ter-Hovhannisian | |
| 2005/0254241 | A1 | 11/2005 | Harwood | |
| 2006/0139942 | A1 | 6/2006 | Pond et al. | |
| 2007/0035951 | A1 | 2/2007 | Tseng | |
| 2007/0062032 | A1 | 3/2007 | Ter-Hovhannssian | |
| 2007/0097693 | A1 | 5/2007 | Klose | |
| 2007/0121328 | A1 | 5/2007 | Mondloch | |
| 2008/0043466 | A1 | 2/2008 | Chakmakjian | |
| 2008/0074889 | A1 | 3/2008 | Gloisten et al. | |
| 2008/0219000 | A1 | 9/2008 | Fan | |

FOREIGN PATENT DOCUMENTS

| | | |
|---|---|---|
| EP | 1030099 | 8/2000 |
| EP | 1 722 158 | 11/2006 |
| EP | 1767967 | 3/2007 |
| EP | 1 818 607 | 8/2007 |
| EP | 2 034 234 | 3/2009 |
| GB | 2 365 962 | 2/2002 |
| JP | 2006-172895 | 6/2006 |
| JP | 2006-228932 | 8/2006 |
| JP | 2008-186776 | 8/2008 |
| JP | 2008-204692 | 9/2008 |
| JP | 2009-9826 | 1/2009 |
| JP | 2009-64637 | 3/2009 |

OTHER PUBLICATIONS

Machine English language translation of JP-2006-228932 published Aug. 31, 2006.
European Search issued in EP Appl 09011025.5 on Oct. 22, 2009.
English abstract of JP-2006-172895.
Machine English language translation of JP-2006-172895.
English Abstract of JP 2008-186776 published Aug. 14, 2008.
Machine Translation of JP 2008-186776 published Aug. 14, 2008.
English Abstract of JP 2008-204692 published Sep. 4, 2008.
Machine Translation of JP 2008-204692 published Sep. 4, 2008.
Chinese First Examination Notification issued Dec. 25, 2009 in CN 2008 101355481.
European Search Report dated Nov. 6, 2008 issued in EP 08163696.
English Language Abstract of JP 2009-064637 published Mar. 26, 2009.
Machine English Language Translation of JP 2009-064637 published Mar. 26, 2009.
English Language Abstract of JP 2009-009826 published Jan. 15, 2009.
Machine English Language Translation of JP 2009-009826 published Jan. 15, 2009.
File History of U.S. Appl. No. 12/717,154 electronically captured on Jan. 20, 2011.
File History of U.S. Appl. No. 12/818,871 electronically captured on Jan. 20, 2011.
File History of U.S. Appl. No. 12/582,721 electronically captured on Jan. 20, 2011.
File History of U.S. Appl. No. 12/757,623 electronically captured on Jan. 20, 2011.
File History of U.S. Appl. No. 12/757,664 electronically captured on Jan. 20, 2011.
File History of U.S. Appl. No. 12/757,596 electronically captured on Jan. 20, 2011.
Extended European Search Report issued in EP 09006842 dated Aug. 10, 2010.
English Language Translation of DE 20 2004 001720 published Apr. 8, 2004.
English Abstract of EP 1,722,158 published Nov. 15, 2006.
Machine Translation of EP 1,722,158 published Nov. 15, 2006.
Extended Search Report issued in EP 10166378.9 on Oct. 6, 2010.
File History of related U.S. Appl. No. 12/757,623 electronically captured on Jan. 21, 2011 to Mar. 31, 2011.
File History of related U.S. Appl. No. 12/757,596 electronically captured on Jan. 21, 2011 to Mar. 31, 2011.
File History of related U.S. Appl. No. 12/757,664 electronically captured on Jan. 21, 2011 to Mar. 31, 2011.

* cited by examiner

REFLECTOR AND LIGHTING APPARATUS COMPRISING REFLECTOR

CROSS-REFERENCE TO RELATED APPLICATIONS

This application is based upon and claims the benefit of priority from prior Japanese Patent Applications No. 2008-134855, filed May 22, 2008; and No. 2009-071275, filed Mar. 24, 2009, the entire contents of both of which are incorporated herein by reference.

BACKGROUND OF THE INVENTION

1. Field of the Invention

The present invention relates to a reflector suitable for a lighting apparatus which uses a plurality of light-emitting elements such as LEDs, and to a lighting apparatus including the reflector.

2. Description of the Related Art

Recently, lighting apparatus which uses a plurality of light-emitting elements such as LEDs as light sources have been developed. For lighting apparatus of this type, there has been an increasing demand of increasing their outputs, and also a tendency of increasing light-emitting element employed in the apparatus. Further, such lighting apparatus which employs a plurality of light-emitting elements is equipped with a reflector for efficiently controlling luminous intensity distribution of light from each light-emitting element. There is a tendency that such a reflector is increased in size as the number of light-emitting elements employed is increased.

Reflectors are subjected to heating and cooling by heat from the light sources as the lighting apparatus is turned on and off, and they repeatedly undergo thermal expansion and thermal contraction. For this reason, reflectors are easily warped or deformed due to heat, and if the reflection surfaces are deformed, it is no longer possible to perform desired luminous intensity distribution control.

Although it is not a case of a reflector, lighting apparatus in which a light transmitting lens body formed into a thin column is used as means for controlling luminous intensity distribution of light emitted from light from a plurality of LEDs has been known. (For example, see Jpn. Pat. Appln. KOKAI Publication No. 2006-172895.) The lens body disclosed in this publication includes a plurality of recess portions which correspond to a plurality of LEDs, and it transmit light emitted from these LEDS and performs the luminous intensity distribution control.

However, this publication makes no mention of means for assuring the desired luminous intensity distribution control by preventing the warpage and deformation of the lens body caused by heat.

BRIEF SUMMARY OF THE INVENTION

An object of the present invention is to provide a reflector which can prevent the warpage and deformation of itself caused by heat, thereby enabling a desired luminous intensity distribution control, and illumination apparatus equipped with this reflector.

In order to achieve the above-described object, there is provided according to an embodiment of the present invention a reflector comprising: a plurality of floodlight openings respectively exposing a plurality of light-emitting elements to a front surface side; a plurality of partition walls which respectively partition the plurality of floodlight openings by respectively surrounding them; and a plurality of reflection concave surfaces each which open and widen from a respective one of the plurality of floodlight openings towards ridge lines of the plurality of partition walls which respectively surround the plurality of floodlight openings.

Further, there is provided according to an embodiment of the present invention illumination apparatus comprising: a thermally conductive main body; the reflector built in the main body; a substrate mounted between the main body and the reflector, on which the plurality of light-emitting elements are provided; and securing means provided on a rear surface of the reflector at a position corresponding to the plurality of radial partition walls, for securing the main body and the reflector.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

A reflector and lighting apparatus according to the first embodiment of the present invention will now be described with reference to FIGS. 1 to 7. As an example of the lighting apparatus, the case where the present invention is applied to a down light 1 will be discussed.

Figure 1:
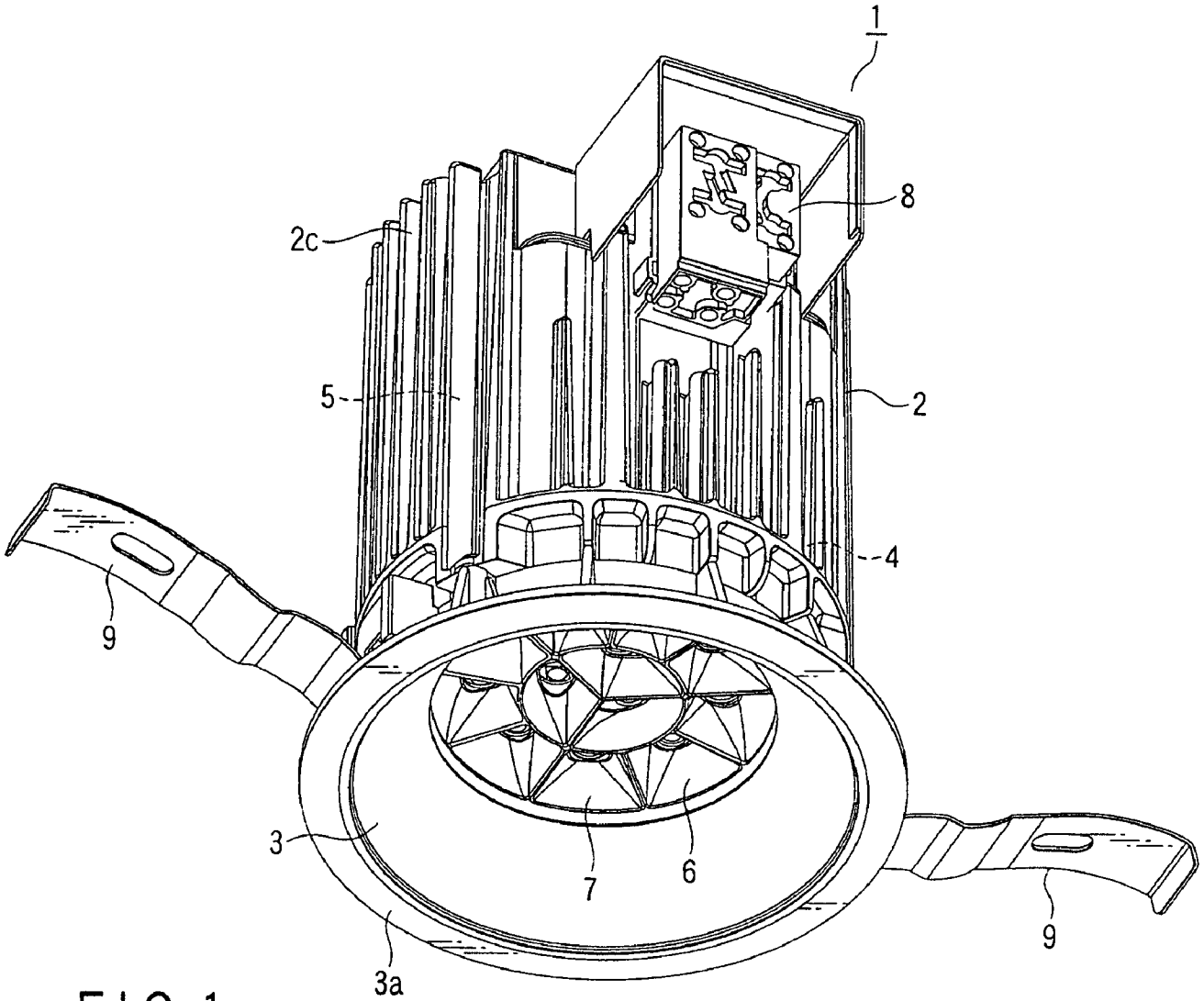
FIG. 1 is a perspective view of a down light according to the first embodiment as lighting apparatus of the present invention.
Figure 2:
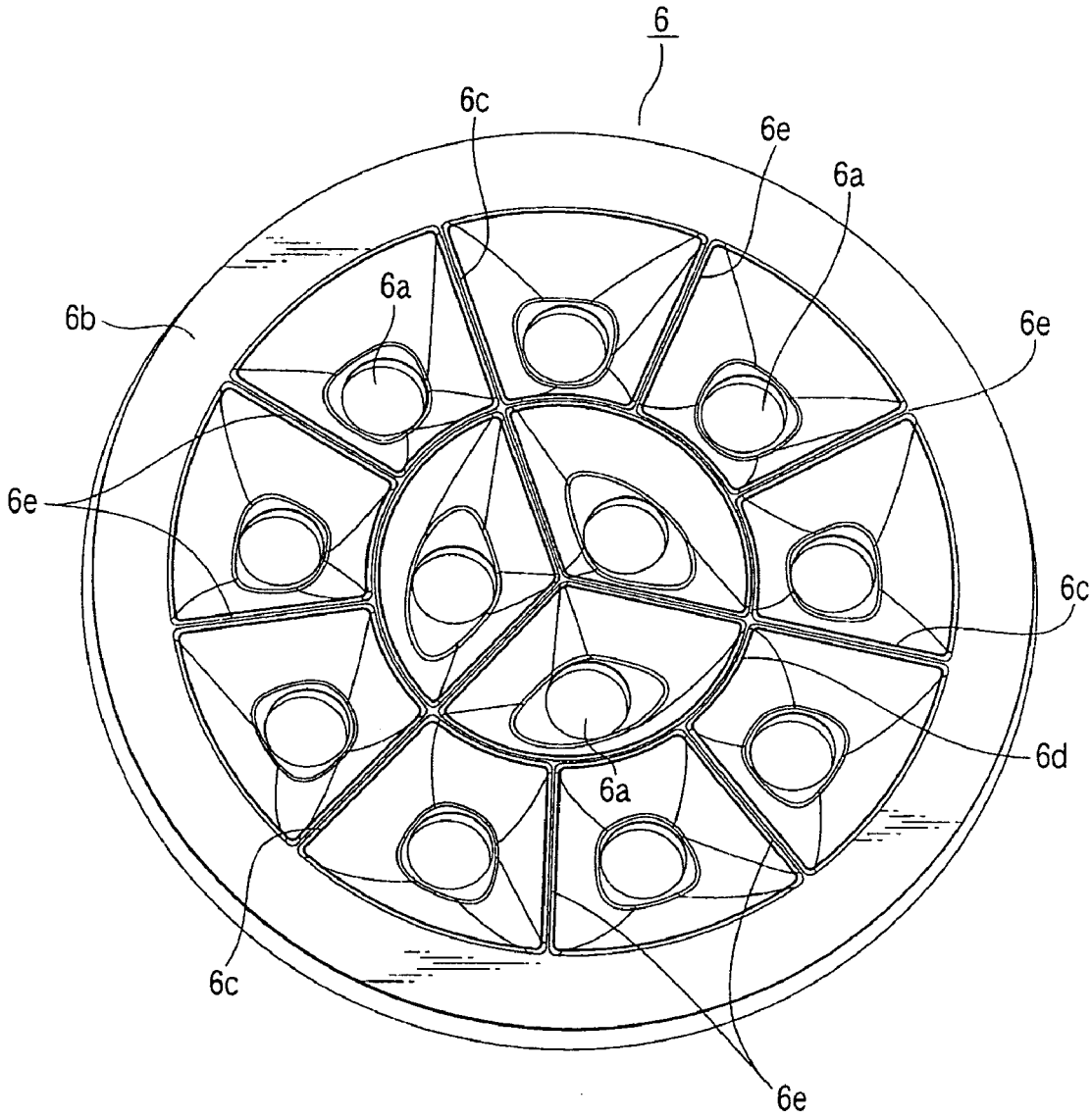
FIG. 2 is a perspective view of a reflector built in the down light shown in FIG. 1.
Figure 3:
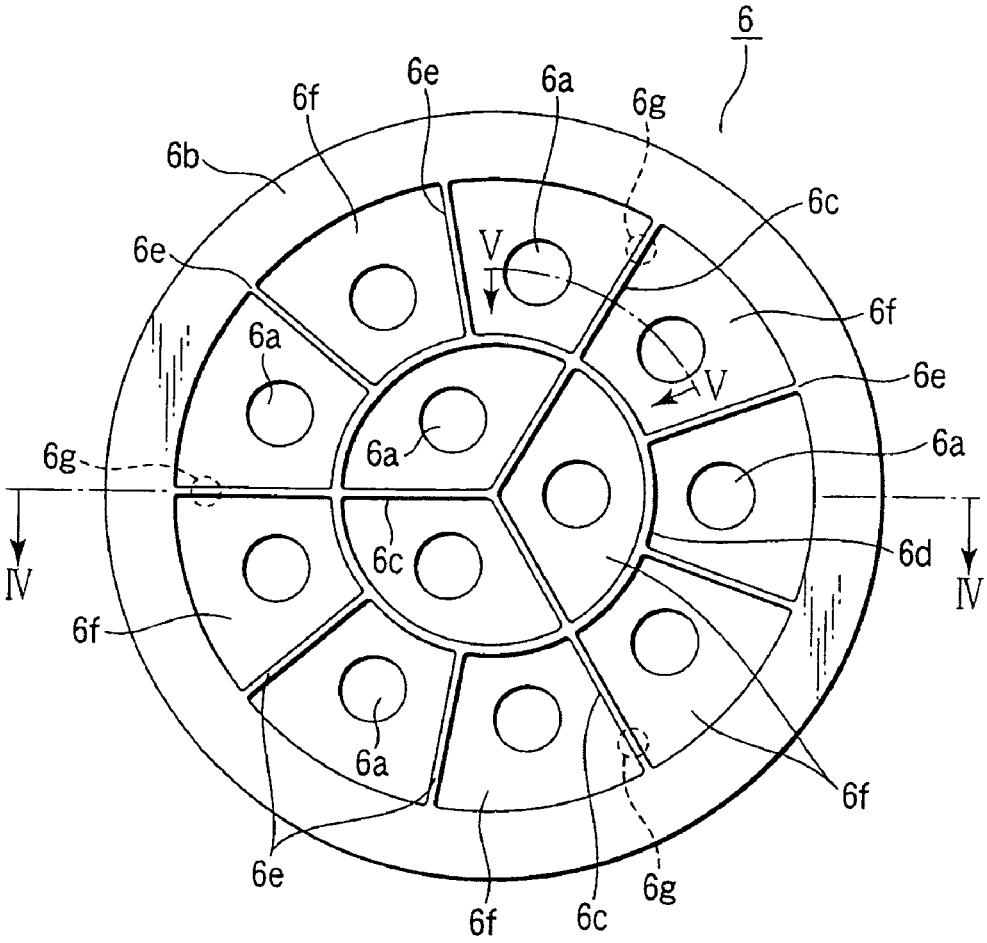
FIG. 3 is a diagram of the reflector shown in FIG. 2 from a front surface side.
Figure 4:
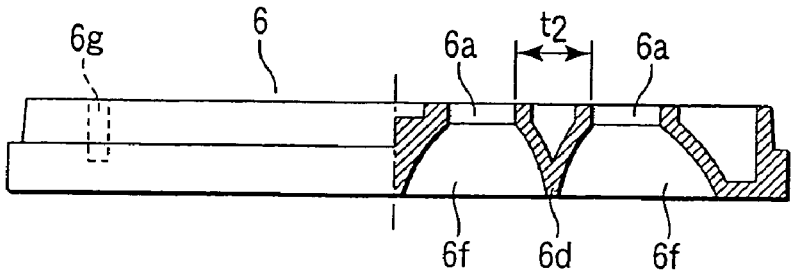
FIG. 4 is a cross sectional view taken along the line IV-IV in FIG. 3.
Figure 5:
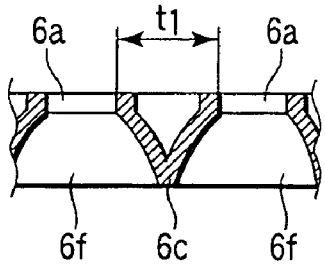
FIG. 5 is a cross sectional view taken along the line IV-IV in FIG. 3.
Figure 6:
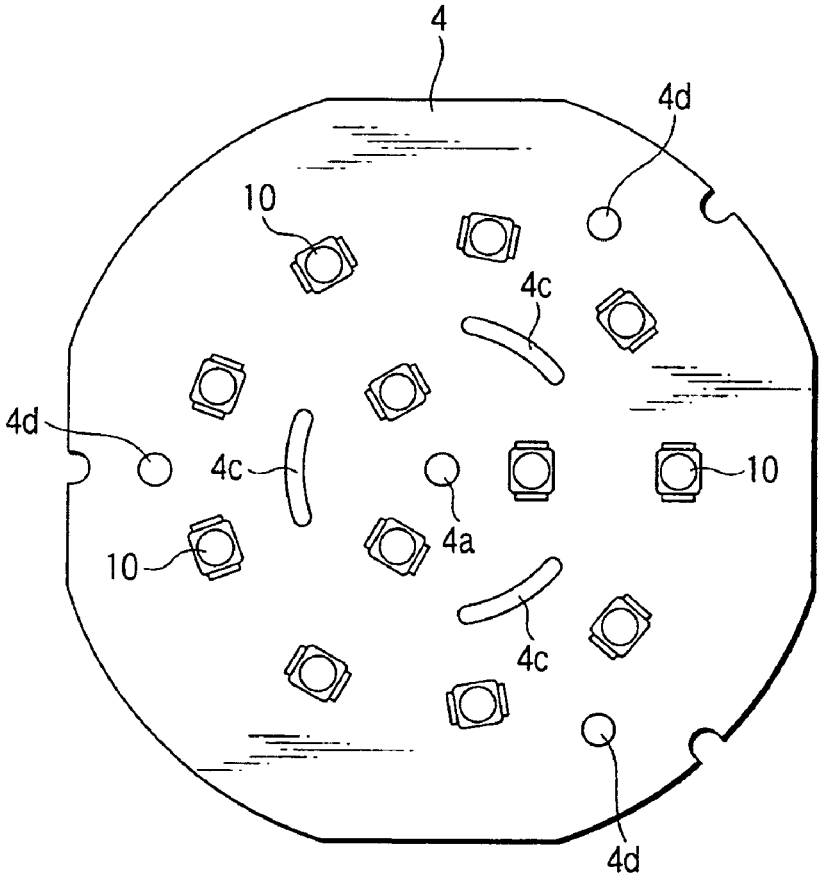
FIG. 6 is a diagram of a substrate built in the down light shown in FIG. 1, viewed from a front surface side.
Figure 7:
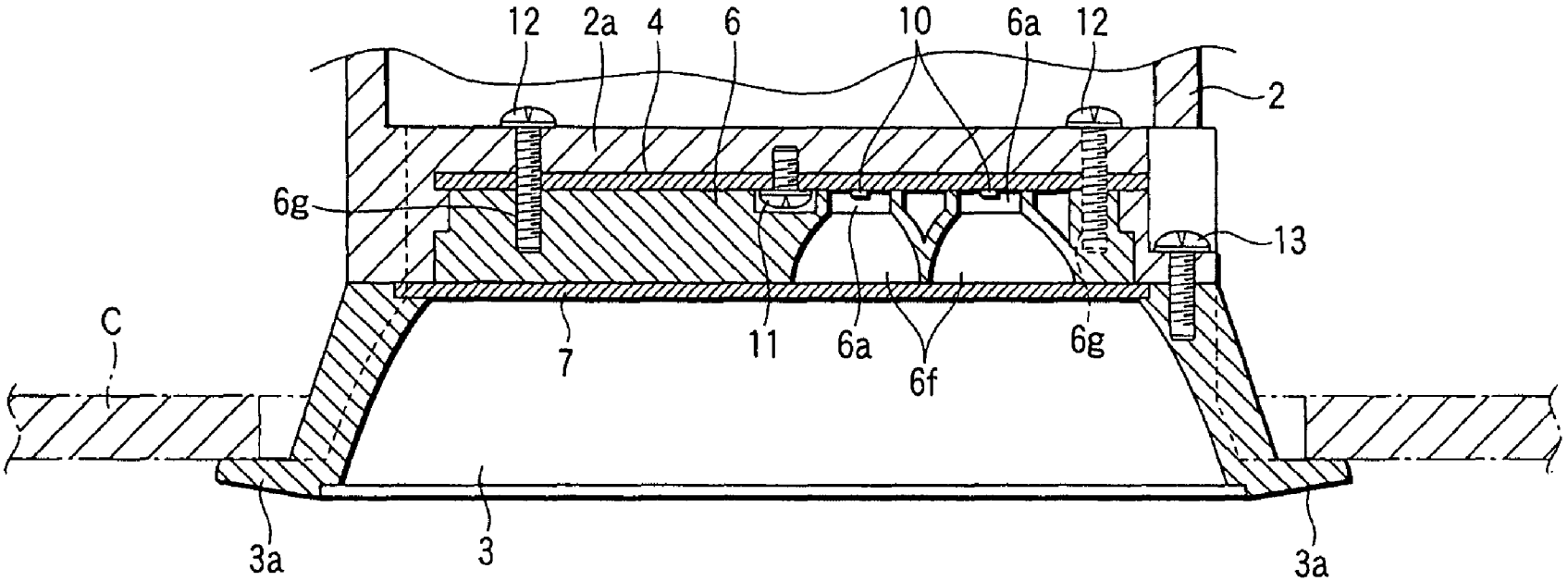
FIG. 7 is a partially enlarged cross sectional view of the down light shown in FIG. 1, a main portion thereof illustrated on larger scale.

FIG. 1 is a perspective view of the down light 1, FIG. 2 is a perspective view of a reflector 6 built in the down light 1, FIG. 3 is a diagram of the reflector 6 viewed from a front surface side, FIG. 4 is a cross sectional view taken along the line IV-IV in FIG. 3, FIG. 5 is a cross sectional view taken along the line V-V in FIG. 3, FIG. 6 is a diagram of a substrate 4 built in the down light 1 shown in FIG. 1, viewed from a front surface side, FIG. 7 is a partially enlarged cross sectional view of the down light 1 shown in FIG. 1, the main portion thereof being illustrated on larger scale.

As light-emitting elements serving as the light source of the down light 1, solid-state light-emitting elements such as light-emitting diode (LED) and organic electro-luminescence (organic EL) are considered. It is preferable that the light-emitting element should be mounted on a substrate by the chip-on-board method or surface mounting method; however the present invention is not limited to these mounting methods. Further, the number of light-emitting elements can be set arbitrarily. In each of the following embodiments, the case where an LED 10 is employed as a light-emitting element will be discussed.

FIG. 1 is a perspective view of the down light 1 of the ceiling built-in type. The down light 1 includes a cylindrical main body 2, a decorative frame 3, a substrate 4, a power unit 5, a reflector 6, a light transmitting cover 7, a terminal block 8 and a mounting leaf spring 9. The substrate 4 and power unit 5 are housed within the cylindrical main body 2.

The cylindrical main body 2 is formed of an aluminum die casting, which has a relatively high thermal conductivity. Besides this, it is possible that the cylindrical main body 2 is formed of some other material which has a high thermal conductivity. An outer circumferential surface of the cylindrical main body 2 is provided a plurality of heat releasing fins 2*c* each extending in an axial direction. Further, the outer circumferential surface is subjected to baking finishing with a white-color melanin resin-based paint. The terminal block 8 to be connected to a utility power is mounted to the outer circumferential surface of the cylindrical main body 2.

The decorative frame 3 is mounted to the lower end of the cylindrical main body 2. The decorative frame 3 is farmed of ABS resin. The decorative frame 3 is formed into an umbrella shape which widens downwards from the end of the cylindrical main body 2 where the frame is mounted, and an annular-shaped flange 3*a* is formed on the opening end where the frame is widened at maximum. Further, a pair of mounting leaf springs 9 are placed on an inclining outer surface of the decorative frame 3.

As can be seen in FIG. 6, a plurality of (twelve in this embodiment) LEDs 10 are mounted on the substrate 4. The substrate 4 is placed in a space between the bottom wall 2*a* of the cylindrical main body and the decorative frame 3 described above, as shown in FIG. 7. In more detail, the rear surface of the substrate 4 is brought into contact with the lower surface of the bottom wall 2*a* of the cylindrical main body 2, and the rear surface of the reflector 6 is brought into contact with the surface side of the substrate 4. Then, the decorative frame 3 is mounted to the surface side of the reflector 6 while interposing the light transmitting cover 7 therebetween.

The power unit 5 has the structure in which electronic parts such as controller-use ICs, transformers, capacitors and the like are mounted on a circuit board, which is not shown in the figure. The power unit 5 controls the lighting of the LEDs 10 by its lighting circuits. Further, the power unit 5 is electrically connected to the terminal block 8.

FIG. 2 is a perspective diagram of the reflector 6 when viewed from its front surface side. The reflector 6 has a substantially columnar external shape having a relatively short dimension in its axial direction, and it is made of, for example, a white color polycarbonate or ABS resin. The reflector 6 is placed on the front surface side of the substrate, that is, on the lighting side of the LEDs 10, so as to perform luminous intensity distribution control which guide the light emitted from each of the LEDs 10 in its respectively desired direction at a desired intensity.

The reflector 6 of this embodiment contains twelve round floodlight openings 6*a* on the rear surface side thereof, which is brought into contact with the substrate 4. The twelve round floodlight openings 6*a* expose the twelve LEDs 10 mounted on the substrate 4, respectively, to the front surface of the reflector 6. Further, the reflector 6 includes an annular-shaped outer peripheral portion 6*b* on its outer circumference. The outer peripheral portion 6*b* functions as one of partition walls, which has a height substantially the same as the axial length of the reflector 6.

Within the outer peripheral portion 6*b*, twelve reflection concave surfaces 6*f* are formed in the front surface side of the reflector 6 so as to correspond to the twelve round floodlight openings 6*a*, respectively. Each of the twelve reflection concave surfaces 6*f* is partitioned by a plurality of partition walls 6*c*, 6*d* and 6*e* each having an angle shape in cross section. These plurality of partition walls 6*c*, 6*d* and 6*e* each have a height substantially the same as the axial length of the reflector 6 as well. Each of the reflection concave surfaces 6*f* has such a shape that it opens wider on the front surface side of the reflector from the floodlight opening 6*a* at its bottom portion towards the ridge line of each of the surrounding partition walls 6*c*, 6*d* and 6*e*. More specifically, each of the reflection concave surfaces 6*f* has such a shape of substantially a bowl, whose cross section is as shown in FIGS. 4, 5 and 7.

In order detail, on the front surface side of the reflector 6, three radial partition walls 6*c* radially extending from its central portion towards the outer peripheral portion 6*b* are formed. The three radial partition walls 6*c* are arranged at intervals of about 120 degrees from each other. Further, within the outer peripheral portion 6*b*, a round inner circumferential partition wall 6*d* is formed such as to divide each of the radial partition walls 6*c* into two. Furthermore, two dividing partition walls 6*e* are formed in a radial arrangement from an outer wall of the inner circumferential partition wall 6*d* located in the middle of each of the radial partition walls 6*c* towards the outer circumferential portion 6*b* (a total of six dividing partition walls 6*e*). Each of the plurality of types of partition walls 6*b*, 6*c*, 6*d* and 6*e* is formed to have an angle shape in its cross section as can be seen in FIGS. 4, 5 and 7.

That is, within the round inner circumferential partition wall 6*d*, three reflection concave surfaces 6*f* each having substantially a fan shape, which are partitioned by the three radial partition walls 6*c*, are formed. Further, within the outer circumferential portion 6*b* but outside of the inner circumferential partition wall 6*d*, nine reflection concave surfaces 6*f* each having substantially a trapezoidal shape, which are partitioned by the three radial partition walls 6*c* and the six dividing partition walls 6*e*, are formed. Furthermore, at the bottom of each of a total of twelve reflection concave surfaces 6*f*, a floodlight opening 6*a* is formed to expose the respective LED 10.

For example, the three reflection concave surfaces 6*f* each having substantially a fan shape inside the inner circumferential partition wall 6*d*, are surrounded respectively by the ridge line of the inner circumferential partition wall 6*d* and the ridge lines of the radial partition walls 6*c*. On the other hand, the nine reflection concave surfaces 6*f* each having substantially a trapezoidal shape, in the outside of the inner circumferential partition wall 6*d* are surrounded respectively by the ridge line of the outer circumferential portion 6*b*, the ridge lines of the radial partition walls 6*c*, the ridge line of the inner circumferential partition wall 6*d* and the ridge lines of the dividing partition walls 6*e*.

When the twelve LEDs 10 of the down light 1 having the above-described structure are turned on, light emitted from each of the LEDs 10 passes through the light transmitting cover 7 directly and also reflects on the above-described twelve reflection concave surfaces 6*f* of the reflector and the reflection light passes through the light transmitting cover 7 as well. Here, when the twelve reflection concave surfaces 6*f* are designed to have an appropriate shape, the distribution of the light emitted from each of the LEDs 10 can be controlled. Thus, it becomes possible to perform highly efficient luminous intensity distribution control in the down light 1 as a whole.

However, as mentioned before, the twelve LEDs 10 are lighted at the same time, the reflector 6 is heated by the heat generated from each of the LEDs 10, and there is a possibility where warpage and deformation occur in the reflector 6. If the reflector 6 is deformed as mentioned, the twelve reflection concave surfaces 6*f* are deformed as well, thereby disabling to perform desired luminous intensity distribution control. In this embodiment, in order to prevent such undesirable deformation of the reflector 6 caused by heat, the thickness of the three radial partition walls 6*c* and the thickness of the round inner circumferential partition wall 6*d* were designed.

The thickness of each of the partition walls 6*c* and 6*d* here is defined as the thickness of the thickest portion when the respective partition wall is cut along the imaginary line passing through the center of the floodlight opening 6*a* of the respective one of the two adjacent reflection concave surfaces 6*f* interposing the partition wall. For example, the thickness of the radial partition walls 6*c* is that of the thickest portion in the cross section of the radial partition walls 6*c* (FIG. 5) cut along the line V-V shown in FIG. 3. Then, the distance between two floodlight openings 6*a* adjacent to each other while interposing the partition wall 6*c* is defined as an inter-periphery distance t1. On the other hand, the thickness of the inner circumferential partition wall 6*d* is that of the thickest portion in the cross section of the inner circumferential partition wall 6*d* (FIG. 4) cut along the line IV-IV shown in FIG. 3. Then, the distance between two floodlight openings 6*a* adjacent to each other while interposing the partition wall 6*d* is defined as an inter-periphery distance t2.

As mentioned above, the three radial partition walls 6*c* are radially extending from the central portion of the reflector 6 towards the outer peripheral portion 6*b* which is the thickest portion, and they form a skeletal frame of the reflector. With this structure, it is required that the three radial partition walls 6*c* should have a rigidity. On the other hand, the thickness t1 of the radial partition wall 6*c* is increased to enhance the rigidity, the rate of the thermal deformation (thermal expansion and thermal contraction) becomes large. Under these circumstances, in this embodiment, the rigidity of the inner circumferential partition wall 6*d* was lowered in order to absorb the stress generated by the heat deformation of the radial partition walls 6*c*.

In other words, in this embodiment, the thickness t1 of the radial partition walls 6*c* and the thickness t2 of the inner circumferential partition wall 6*d* is set such as to satisfy the relationship t1>t2. With this definition, the rigidity of the radial partition walls 6*c* can be increased, and even in case where the radial partition walls 6*c* are deformed, the inner circumferential partition wall 6*d*, which is formed to have a low rigidity, can absorb the stress. In this manner, the deformation of the reflector 6 caused by heat can be effectively suppressed, and it becomes possible to perform a desired luminous intensity distribution control over a long period of time.

It should be noted that since the reflector 6 of this embodiment employs such a structure that the three reflection concave surfaces of on the inner circumferential side and the nine reflection concave surfaces 6*f* on the outer circumferential side are divided by the round the inner circumferential partition wall 6*d*, it becomes possible to increase the number of reflection concave surfaces 6*f* to correspond to the plurality of LEDs 10. As a result, the output of the down light 1 can be increased, that is, it becomes possible to increase the number of LEDs employed.

Further, the reflector 6 is exposed to the heat generated from the LEDs 10 and undergoes expansion and contraction repeatedly. However, the radial partition walls 6*c* extend out over substantially the entire surface of the reflector 6 to form the skeletal frame, that is, the so-called core, and with this structure, it is possible to suppress warpage and deformation which may occur to the reflector 6. If there rises such a state where deformation occurs to the reflector 6, the deformation of the radial partition walls 6*c* can be absorbed on the inner circumferential radial partition wall 6*d* side for the following reason. That is, the inner circumferential radial partition wall 6*d* is formed thinner than the radial partition walls 6*c*, and therefore the rigidity of the inner circumferential radial partition wall 6*d* is lower than that of the radial partition walls 6*c*. With this arrangement, the radial partition walls 6*c* do not easily deform, and the deformation of the radial partition walls 6*c* is absorbed on the inner circumferential radial partition wall 6*d* side. Thus, even in case where the deformation occurs to the radial partition walls 6*c*, severe deformation of the reflector 6 as a whole can be suppressed.

Now, the reflector 6 having the above-described structure and the structure for mounting its peripheral members will be described with reference to FIGS. 6 and 7.

As shown in FIG. 6, a plurality of LEDs 10 are mounted on the front surface side of the substrate 4 by the surface mounting method, and more specifically, a total of twelve of them, three are placed near the central portion and nine are placed around them. These twelve LEDs 10 are placed at positions corresponding to the above-described twelve floodlight openings 6*a* of the reflector 6.

The substrate 4 is made of an insulation material or a metal-made substantially round disk, and has a screw through hole 4*a* at its center and three screw through holes 4*b* near the peripheral portion thereof arranged at intervals of 120 degrees from each other. It should be noted that a slit 4*c* is formed between the central screw through hole 4*a* and each of the three surrounding screw through holes 4*b*, and each slit 4*c* serves as means which absorbs expansion and contraction caused by the thermal expansion of the substrate 4.

Here, in the case where the substrate 4 is to be formed of an insulating material, it is desirable that a ceramic material or a synthetic resin material, which has a relatively good heat radiating property and an excellent durability, should be employed. In the case where the substrate 4 is to be formed of a synthetic resin material, it is desirable that, for example, a glass epoxy resin or the like should be employed. Or, in the case where the substrate 4 is to be formed of a metal, a material having a good thermal conductivity and an excellent heat radiating property, such as aluminum, should be employed.

As can be seen in FIG. 7 (in which the illustration of the mounting leaf spring 9 is omitted), the substrate 4 is placed on the bottom wall 2*a* of the cylindrical main body 2 such that the rear surface of the substrate 4 is brought into contact by surface thereto. Further, the reflector 6 is placed on the front surface of the substrate 4 such chat the rear surface of the reflector 6 is brought into contact therewith. In other words, the substrate 4 is sandwiched between the bottom wall 2*a* of the cylindrical main body 2 and the reflector 6.

When the substrate 4 and reflector 6 are to be mounted to the bottom wall 2*a*, first, the substrate 4 is secured to the bottom wall 2*a*. During this process, the mounting screw 11 is put through the central screw through hole 4*a* from the front surface side of the substrate 4, and then screwed together with a threaded hole of the bottom wall 2*a*, thereby securing the substrate 4 to the bottom wall 2*a* by engagement. Then, the reflector 6 is placed on top of the front surface side of the substrate 4 such that the twelve LEDs 10 mounted on the surface of the substrate 4 are respectively located within the corresponding twelve floodlight openings 6*a*. While maintaining this state, three mounting screws which function as securing means of the present invention (only two of them are illustrated and one of the two is illustrated with an imaginary line) are put through the screw through hole of the bottom wall 2*a* and the screw through holes 4*b* of the substrate 4 from the rear surface side of the bottom wall 2*a* of the cylindrical main body 2, and they are screwed together with threaded holes 6*g* formed in the rear surface side of the reflector 6. The three threaded holes 6*g* of the reflector 6 are provided on the rear surface side of the reflector 6 at positions which overlap with the radial partition walls 6*c* as shown in FIGS. 3 and 4.

While maintaining this state, as the three mounting screws 12 are fastened, the fastening force acts in the direction in which the reflector 6 is pulled towards the bottom wall 2*a*. Thus, the fastening forces for the mounting screw 11 at the central portion of the substrate 4 and the surrounding mounting screws 12 synergistically act together to tightly fasten the rear surface of the substrate 4 onto the front surface of the bottom wall 2*a*. Also, at the same time, the reflector 6 is pushed onto the front surface side of the substrate 4 as well, thereby enhancing the tight connection between them.

After that, the decorative frame 3 is mounted to the cylindrical main body 2 by the mounting screw 13. Then, as the down light 1 is built in a ceiling surface C, the flange 3*a* which has a diameter larger than that of the embedding hole of the ceiling surface C is hooked by the periphery of the embedding hole. It should be noted that the inner circumferential side of the decorative frame 3 is provided with the light transmitting cover 7 made of acryl resin or the like such as to cover the opening of the front surface side of each of the twelve reflection concave surfaces of the reflector 6.

Next, the heat radiating structure when the down light 1 having the above-described structure is turned on, and the thermal deformation of the reflection 6 will now be discussed.

When the power unit 5 is energized, the lighting circuit is driven to supply electric power to the substrate 4, and thus the twelve LEDs 10 emit light. A portion of the light emitted from each of the LEDs 10 transmits the light transmitting cover 7 directly and irradiates forwards. A portion of the light reflects on each of the reflection concave surfaces 6*f* of the reflector 6 and the reflection light is subjected to luminous intensity distribution control. Then, the reflection light passes through the light transmitting cover 7 and irradiates forwards as well.

On the other hand, the heat generated from each of the LEDs 10 propagates mainly from the rear surface of the substrate 4 to the bottom wall 2*a* of the cylindrical main body 2. Further, while being radiated in its propagation process, the heat propagates to the entire body of the cylindrical main body 2, and then radiated through the plurality of heat radiating fins 2*c*. During the heat propagation, the reflector 6 as well is exposed to the heat from the substrate 4; however, due to the structure of the radial partition walls 6*c* described above, the deformation thereof is suppressed. In this manner, the deformation of the reflection concave surfaces 6*f* can be prevented and therefore it is possible to perform desired luminous intensity distribution control.

Further, with the fastening of the reflector 6 described above, the tight connection of the substrate 4 to the bottom wall 2*a* is reliably maintained, thereby making it possible to radiate heat effectively from the substrate 4 to the cylindrical main body 2 and suppress the deformation of the substrate 4 as well. Further, the rear surface of the reflector 6 is brought into contact with the front surface of the substrate 4 by substantially its entire area, and thus the tightness is assured by this way as well. Therefore, due to the heat conduction from the substrate 4 to the reflector 6, it is possible to prevent a regional temperature increase in the substrate 4 and uniform the temperature distribution of the substrate 4. In this manner, the temperatures of the plurality of LEDs 10 can be uniformed.

It should be noted that in the temperature distribution of the substrate 4, there is a tendency of heat concentrating towards the central portion thereof and increasing the temperature in the central portion. In this embodiment, each of the three reflection concave surfaces 6*f* each having substantially a fan shape inside the inner circumferential partition wall 6*d*, is made to have an area larger than that of each of the nine reflection concave surfaces 6*f* each having substantially a trapezoidal shape, in the outside of the inner circumferential partition wall 6*d*. With this structure, the neat radiating area of the central portion is widened, thereby making it possible to further promote the uniformization of temperature. The uniformization of temperature contributes to the quick stabilization of luminous flux when the plurality of LEDs 10 are turned on.

As described above, in the down light 1 of this embodiment, the number of LEDs 10 mounted on the substrate 4 can be increased, and therefore it is possible to meet the demand of a higher output. Further, in the reflector 6 of this embodiment, the deformation thereof due to heat can be suppressed, and therefore it is possible to perform desired luminous intensity distribution control. Further, according to this embodiment, the tight attachment of the substrate onto the cylindrical main body 2 can be assured, and therefore the heat radiation can be effectively performed and even the deformation of the substrate 4 can be prevented.

Figure 8:
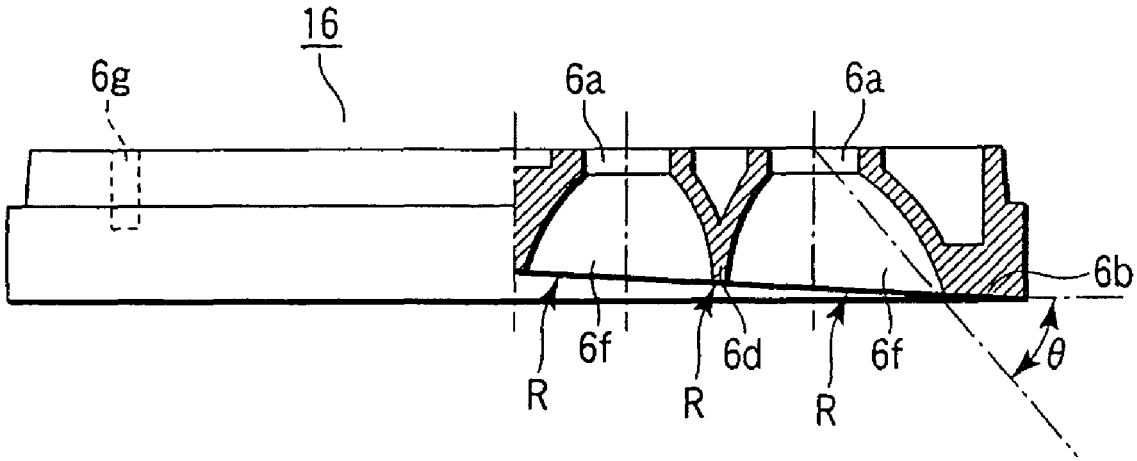
FIG. 8 is a cross sectional, view of a reflector according to the second embodiment.

Next, a reflector 16 according to the second embodiment of the present invention will now be described with reference FIG. 8. FIG. 8 corresponds to FIG. 4 of the first embodiment, and is a diagram showing a cross section of the right half of the reflector from the central line. It should be noted that the identical or corresponding parts to those of the first embodiment will be designated by the same reference symbols, and the repetition of the explanation will be omitted.

This embodiment is characterized in that partition walls 6*b*, 6*c*, 6*d* and 6*e* which partition a plurality of floodlight openings 6*a* are formed to differ in height from each other. More specifically, the outer circumferential portion 6*b*, radial partition walls 6*c*, inner circumferential partition wall 6*d* and dividing partition walls 6*e* are formed such that the heights of the ridge lines R of these gradually increase from the center of the reflector 16 towards the outer circumference. With this configuration, an imaginary plane which contains the ridge lines of all of these partition walls 6*b*, 6*c*, 6*d* and 6*e* makes a concave surface shape with its center being concaved.

In the case where the reflector 16 of this embodiment is built in the down light 1 of FIG. 1, the same operation effect as that of the first embodiment can be exhibited and further it becomes possible to prevent glare of the emitted light of the LEDs 10. In more detail, with the configuration in which these partition walls 6*b*, 6*c*, 6*d* and 6*e* are formed such that the heights of the ridge lines R of these gradually increase from the center towards the outer circumference side, the light shielding angle θ with respect to LEDs 10 placed in floodlight openings 6*a* positioned on the outer circumferential side can be larger as compared to that of those of the inner circumferential side. With this structure, it is possible to narrow the scope of the light emitted from these LEDs 10 coming into view, and therefore glare can be reduced. Further, with use of the reflector of this embodiment, it is possible to prevent the light beams emitted from a plurality of LEDs 10 from simultaneously coming into the eyes of a person approaching the down light 1.

Further, in the case where the ridge lines R are made to differ in height as in this embodiment, these reflection concave surfaces 6*f* are formed to become deeper gradually from the center towards the outer periphery. With this configuration, the mixture of the emitted light from each of the LEDs 10 and its reflection light is promoted, and thus the occurrence of interference fringes can be suppressed.

It should be noted that in order to make the heights of the ridge lines R gradually increase from the center towards the outer circumference side, it is alternatively possible to employ such a method of increasing the heights of the ridge lines intermittently or stepwide, in place of the method of making them increase gradually in a linear or curvature manner as in this embodiment. Also, it should be noted that in place of varying the structure of the reflector 16 as in this embodiment, the material, shape, light transmittance, diffusion factor, spectral absorptivity, and the like of the light transmitting cover 7 can be appropriately selected as needed in order to improve glare, uneven luminance, and the like.

Figure 9:
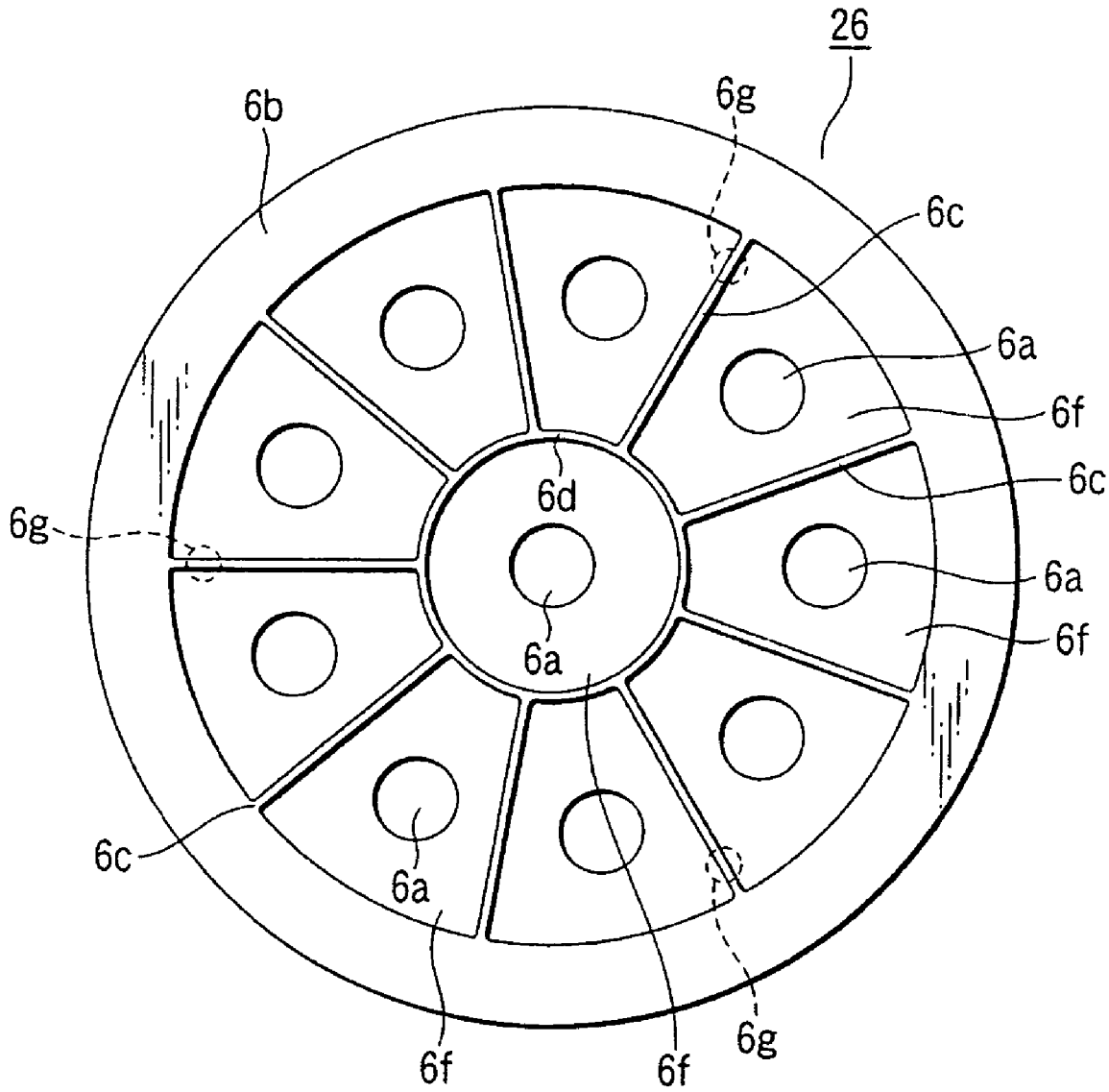
FIG. 9 is a diagram showing a reflector according to the third embodiment, viewed from a front surface side.

Next, a reflector 26 according to the third embodiment of the present invention will now be described with reference FIG. 9. FIG. 9 is a diagram of the reflector 26 when viewed from its front surface side. With regard to the reflector 26 as well, the identical or corresponding parts to those of the first embodiment will be designated by the same reference symbols, and the repetition of the explanation will be omitted.

In this embodiment, a round inner circumferential partition wall 6*d* is formed close to the center of the reflector 26, and nine radial partition walls 6*c* are radially formed from the outer circumferential surface of the inner circumferential partition 6*d* towards the outer peripheral portion 6*b* at intervals of about 40 degrees from each other. Then, with regard to flood light openings 6*a* which expose the LEDs 10, a total of ten openings, that is, one is formed at the center and nine are formed in the surrounding.

As described above, a round reflection concave surface 6*f* having substantially a bowl shape is formed by the inner circumferential partition wall 6*d* which surrounds the floodlight opening 6*a* at the center, and nine reflection concave surfaces of each having substantially a bowl shape and, when viewed in plane, substantially a fan shape, are formed by the nine floodlight openings 6*a* of the surrounding and the inner circumferential partition wall 6*d*, the radial partition walls 6*c* and the outer circumferential portion 6*b*. It should be noted that all of the reflection concave surfaces 6*f* each open and widen from the respective floodlight opening 6*a* at the center towards the respective ridge lines R.

As described above, in the reflector 26 of this embodiment, the radial partition walls 6*c* and the outer circumferential portion 6*b* are formed on the front surface side thereof. With the partition walls 6*c* and 6*d*, the reflection concave surfaces of are formed by subdivision. Thus, the floodlight openings 6*a* and the reflection concave surfaces 6*f* are formed to correspond to the LEDs 10, respectively. With the above-described structure, it is possible to perform fine luminous intensity distribution control as in the cases of the first and second embodiments discussed above. Thus, with the radial partition walls 6*c* and the inner circumferential partition wall 6*d*, the mechanical strength of the reflector 26 can be enhanced. With this structure, even if the reflector 26 is exposed to the heat generated by the LEDs 10 and undergoes expansion and contraction repeatedly, it is possible to suppress the occurrence of warpage and deformation to the reflector 26.

It should be noted here that the radial partition walls 6*c* extending from the inner circumferential partition 6*d* towards the outer peripheral portion 6*b* may not be formed continuously over its entire length, but the radial partition walls 6*c* may be formed intermittently by providing a gap in the middle of each of the walls extending from the inner circumferential partition 6*d* to the outer peripheral portion 6*b*.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the embodiments provided above, the cases where the present invention is applied to a down light, are described. However, note that the present invention is not limited to these cases, but it can be applied to various types of lighting apparatus which employ a plurality of light-emitting elements.

What is claimed is:

1. A lighting apparatus comprising:

a thermally conductive main body;

an annular-shaped reflector mounted on the main body;

a substrate mounted between the main body and the reflector, on which a plurality of light-emitting elements are provided; and securing means for securing the substrate to the main body and securing the main body to the reflector;

wherein the reflector defines a plurality of floodlight openings respectively exposing the plurality of light-emitting elements to a front surface side, the reflector comprising:

a plurality of partition walls which respectively partition the plurality of floodlight openings by respectively surrounding them, the plurality of partition walls including a plurality of radially extending partition walls and at least one inner circumferential partition wall located between a center of the reflector and an outer circumference of the reflector; and a plurality of reflection concave surfaces each which open and widen from a respective one of the plurality of floodlight openings towards ridge lines of the plurality of partition walls which respectively surround the plurality of floodlight openings, wherein a thickness of the radially extending partition walls is larger than a thickness of the at least one inner circumferential partition wall.

2. The reflector according to claim 1, wherein the plurality of partition walls are formed such that a height of the ridge lines of the plurality of partition walls becomes larger from the center of the reflector towards the outer circumference thereof.

* * * * *